US008058224B2

(12) United States Patent
Morgan, III et al.

(10) Patent No.: US 8,058,224 B2
(45) Date of Patent: Nov. 15, 2011

(54) MULTIPLE USE FABRIC CONDITIONING COMPOSITION WITH BLOOMING PERFUME

(75) Inventors: George Kavin Morgan, III, Hamilton, OH (US); Thomas Jackson Kirk, Cincinnati, OH (US); Toan Trinh, Maineville, OH (US); Zaiyou Liu, West Chester, OH (US); Kristin Marie Finley, Cincinnati, OH (US); John William Smith, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 515 days.

(21) Appl. No.: 11/059,709

(22) Filed: Feb. 16, 2005

(65) Prior Publication Data

US 2005/0192207 A1 Sep. 1, 2005

Related U.S. Application Data

(60) Provisional application No. 60/548,374, filed on Feb. 27, 2004, provisional application No. 60/550,555, filed on Mar. 5, 2004, provisional application No. 60/550,669, filed on Mar. 5, 2004, provisional application No. 60/550,557, filed on Mar. 5, 2004, provisional application No. 60/555,860, filed on Mar. 24, 2004, provisional application No. 60/555,950, filed on Mar. 24, 2004, provisional application No. 60/560,121, filed on Apr. 7, 2004, provisional application No. 60/591,032, filed on Jul. 26, 2004.

(51) Int. Cl.
*C11D 17/00* (2006.01)

(52) U.S. Cl. ..... 510/519

(58) Field of Classification Search ..... 510/519
See application file for complete search history.

(56) References Cited

U.S. PATENT DOCUMENTS

| | | | | |
|---|---|---|---|---|
| 3,435,537 | A | 4/1969 | Rumsey, Jr. | |
| 3,634,947 | A | 1/1972 | Furgal | |
| 3,676,199 | A | 7/1972 | Hewitt et al. | |
| 3,696,034 | A | 10/1972 | Hewitt et al. | |
| 3,698,095 | A | 10/1972 | Grand et al. | |
| 3,736,668 | A | 6/1973 | Dillarstone | |
| 3,947,971 | A | 4/1976 | Bauer | |
| 3,948,387 | A | 4/1976 | Haertle | |
| 3,967,008 | A | 6/1976 | Mizuno et al. | |
| 3,977,980 | A | 8/1976 | Fry et al. | |
| 4,004,685 | A | 1/1977 | Mizuno et al. | |
| 4,012,326 | A | 3/1977 | Rudy et al. | |
| 4,014,432 | A | 3/1977 | Clothier et al. | |
| 4,035,307 | A | 7/1977 | Fry et al. | |
| 4,041,205 | A | 8/1977 | Compa et al. | |
| 4,053,992 | A | 10/1977 | Furgal | |
| 4,057,673 | A | 11/1977 | Falivene | |
| 4,098,937 | A | 7/1978 | Mizuno et al. | |
| 4,105,813 | A | 8/1978 | Mizuno et al. | |
| 4,108,600 | A | 8/1978 | Wong | |
| 4,137,345 | A | 1/1979 | Falivene | |
| 4,141,841 | A | 2/1979 | McDanald | |
| 4,149,977 | A | 4/1979 | Morganson et al. | |
| 4,223,029 | A | 9/1980 | Mahler et al. | |
| 4,328,110 | A | 5/1982 | Green | |
| 4,514,444 | A | 4/1985 | Ives et al. | |
| 4,642,258 | A | 2/1987 | Majewski et al. | |
| 4,769,159 | A | 9/1988 | Copeland | |
| 5,020,240 | A | 6/1991 | Lee | |
| 5,480,567 | A | 1/1996 | Lam et al. | |
| 5,500,137 | A | 3/1996 | Bacon et al. | |
| 5,510,042 | A | 4/1996 | Hartman et al. | |
| 5,562,847 | A | 10/1996 | Waite et al. | |
| 5,668,094 | A | 9/1997 | Bacon et al. | |
| 5,787,606 | A | 8/1998 | Bokholdt | |
| 6,103,678 | A | 8/2000 | Masschelein et al. | |
| 6,107,270 | A * | 8/2000 | Smith et al. | 510/516 |
| 6,910,641 | B2 | 6/2005 | Griese et al. | |
| 7,087,572 | B2 | 8/2006 | Hubig et al. | |
| 7,524,809 | B2 | 4/2009 | Trinh et al. | |
| 2002/0032147 | A1* | 3/2002 | Foley et al. | 512/25 |
| 2002/0078589 | A1 | 6/2002 | Hagemann et al. | |
| 2003/0013632 | A1* | 1/2003 | Santos et al. | 510/515 |
| 2003/0050220 | A1* | 3/2003 | Trinh et al. | 510/521 |
| 2003/0195130 | A1* | 10/2003 | Lentsch et al. | 510/327 |
| 2004/0167056 | A1 | 8/2004 | Lentsch et al. | |
| 2005/0192203 | A1 | 9/2005 | Trinh et al. | |
| 2005/0192204 | A1 | 9/2005 | Trinh et al. | |
| 2005/0192205 | A1 | 9/2005 | Trinh et al. | |
| 2005/0192206 | A1 | 9/2005 | O'Brien et al. | |
| 2005/0202999 | A1 | 9/2005 | Woo et al. | |
| 2005/0229653 | A1 | 10/2005 | Trinh et al. | |

FOREIGN PATENT DOCUMENTS

| | | | |
|---|---|---|---|
| CA | 1021559 | | 11/1977 |
| DE | 2 350 574 | | 4/1974 |
| EP | 0 000 416 | A1 | 1/1979 |
| EP | 0 154 359 | B1 | 9/1985 |
| WO | WO94/22999 | | 10/1994 |
| WO | WO98/27191 | | 6/1998 |
| WO | WO 99/65458 | * | 12/1999 |
| WO | WO 03/087282 | A1 | 10/2003 |
| WO | WO 03/087463 | A1 | 10/2003 |
| WO | WO2004/094580 | A2 | 11/2004 |

OTHER PUBLICATIONS

International Search Report, PCT/US2005/006390, 2 pages.
U.S. Appl. No. 11/059,092, filed Feb. 16, 2005, Response to Office Action dated Jun. 6, 2008.
U.S. Appl. No. 11/059,092, filed Feb. 16, 2005, Declaration submitted with Response to Office Action dated Jun. 6, 2008.
Supplemental Notice of Allowability, U.S. Appl. No. 11/059,092, mailed on Jan. 29, 2009, 2 pages.
Notice of Allowance, U.S. Appl. No. 11/059,092, mailed on Dec. 17, 2008, 8 pages.
Final Office Action, U.S. Appl. No. 11/059,092, mailed on Jun. 6, 2008, 7 pages.
Non Final Office Action, U.S. Appl. No. 11/059,092, mailed on Nov. 21, 2007, 8 pages.
Detailed Action—Election/Restrictions, U.S. Appl. No. 11/059,092, mailed on Aug. 9, 2007, 3 pages.
Requirement for Restriction/Election, U.S. Appl. No. 11/059,092, mailed on May 24, 2007, 6 pages.
International Search Report, PCT/US2005/006384, mailed on May 27, 2005, 4 pages.

* cited by examiner

*Primary Examiner* — John R Hardee
(74) *Attorney, Agent, or Firm* — Gary J. Foose

(57) ABSTRACT

Multiple use fabric conditioning compositions comprising blooming perfume are useful for conditioning fabric.

14 Claims, No Drawings

MULTIPLE USE FABRIC CONDITIONING COMPOSITION WITH BLOOMING PERFUME

CROSS-REFERENCE TO RELATED APPLICATIONS

This application claims benefit to the following U.S. Provisional Patent Applications: 60/548,374, filed Feb. 27, 2004; 60/550,555, filed Mar. 5, 2004; 60/550,669, filed Mar. 5, 2004; 60/550,557, filed Mar. 5, 2004; 60/555,860 filed Mar. 24, 2004; 60/555,950 filed Mar. 24, 2004; 60/560,121, filed Apr. 7, 2004; and 60/591,032, filed Jul. 26, 2004, the disclosures of which are all hereby incorporated by

FIELD OF THE INVENTION

The invention relates to an improved fabric conditioning composition and to methods for using the composition.

BACKGROUND OF THE INVENTION

Heretofore, most dryer-added fabric conditioning products contain a perfume to deposit some fragrance onto the laundered fabrics, both to provide an olfactory aesthetic benefit and to serve as a signal that the fabrics are clean. Fabric conditioning compositions in the art commonly contain perfumes to provide a good odor to fabrics. Typical perfume compounds and compositions can be found in the art including U.S. Pat. No. 4,145,184, Brain and Cummins, issued Mar. 20, 1979; U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979. Due to the high energy input and large air flow in the drying process used in the typical automatic clothes dryers, a large part of the perfume provided by such fabric conditioning products has been lost out the dryer vent. Even for the less volatile components, only a small fraction remains on the fabrics after the drying cycle. The loss of the highly volatile fraction of the perfume is much higher. Usually the loss of the highly volatile fraction is substantial, often practically total. Due to this problem most laundry perfumes have been composed mainly of less volatile perfume components to survive the drying cycle and thus provide better "fabric substantivity." The main function of a small fraction of the highly volatile perfume components in these perfumes is sometimes just to improve the fragrance odor of the product itself, rather than significantly impacting on the subsequent fabric odor. However, some of the non-substantive, volatile perfume ingredients can provide a desirable fresh and clean impression to the fabrics, and it is highly desirable that these ingredients be deposited and present on the dried fabrics. Methods have been devised using perfume carriers to deliver these desirable, highly volatile perfume ingredients from dryer-added fabric conditioning products. Thus, U.S. Pat. No. 5,102,564 issued Apr. 7, 1992 to Gardlik et al. discloses the use of cyclodextrins to encapsulate the volatile perfume ingredients for use in dryer-added fabric conditioning sheets, to deliver such perfume to the fabrics. U.S. Pat. No. 5,830,835 issued Nov. 3, 1998 to Severns et al. discloses the use of pro-perfumes which are subsequently hydrolyzed to release volatile perfume ingredients in dryer-added fabric conditioning compositions. U.S. Pat. Appl. Publ. No. 2003/0013632 A1 published Jan. 16, 2003 to Santos et al. discloses the use of zeolites as a perfume carrier to deliver volatile perfume ingredients from dryer-added sheets. Efforts are continued to find ways to deliver the neat, free volatile perfume ingredients without having to use the expensive and/or complicated perfume carriers.

Dryer-added fabric conditioning products provide a better convenience to the consumer as compared to the rinse-added fabric conditioning products because they spare the consumer the requirement of having to be present right at the beginning of the rinse cycle.

There are two main types of dryer-added fabric conditioning products, namely, single use product and multiple-use products. Single use products, most commonly in the sheet form coated with a fabric conditioning active composition, calls for adding a single sheet into an automatic clothes dryer containing a wet laundry load, at the beginning of the drying cycle. Examples of this type of product are disclosed in U.S. Pat. No. 3,442,692 to Gaiser and U.S. Pat. No. 3,686,025 to Morton et al.

Multiple-use fabric conditioning products are placed in the interior of the dryer to release the fabric conditioning active to successive laundry loads. Each multiple-use product lasts many drying cycles, from a few cycles to about 50 or more cycles, and thus provides a better convenience to the consumer than single use products. One type of multiple-use products consists of a dispenser that is attached to the interior of an automatic clothes dryer, said dispenser having a permeable surface and containing a fabric conditioning active composition that is a solid at room temperature and is softenable at the operating temperature of said clothes dryer. In use, the hot operating temperature of the clothes dryer softens or melts the conditioning active which then passes through the permeable surface and is transferred to the fabric being treated by contact to provide the desired fabric conditioning benefits. Multiple-use products of this type are disclosed, e.g., in U.S. Pat. No. 3,967,008 issued Jun. 29, 1976 and U.S. Pat. No. 4,004,685 issued Jan. 25, 1977, both to Mizuno et al., and U.S. Pat. No. 4,149,977 issued Apr. 17, 1979 to Morganson et al.

Another type of multiple-use products has the conditioning active not covered by a permeable surface, but is instead exposed to be transferred to the fabric. The products can be attached to the interior of the dryer, as disclosed in U.S. Pat. No. 3,696,034 issued Oct. 3, 1972, U.S. Pat. Appl. Publ. No. 2003/0192197 A1 published Oct. 16, 2003 to Griese et al., and U.S. Pat. Appl. Publ. No. 2003/0195130 A1 published Oct. 16, 2003 to Lentsch et al. The products can also be unattached and tumbled along with the clothes in the dryer interior, as is disclosed in U.S. Pat. No. 3,676,199 issued Jul. 11, 1972 to Hewitt et al. The softener active, which is preferably solid at room temperature, can soften or melt under the clothes dryer operating temperature, such as those disclosed in U.S. Pat. Nos. 3,676,199 and 3,696,034, or only softens at a temperature above the clothes dryer operating temperature, such as those disclosed in U.S. Pat. Appl. Publ. Nos. 2003/0192197 and 2003/0195130 A1.

It is very desirable to be able to provide volatile perfume ingredients to fabrics to impart a freshening benefit. Accordingly, there is a need for a dryer-added fabric conditioning composition that can deliver a higher level of volatile perfume ingredients than conventional dryer-added fabric conditioning products. In the fabric conditioning product art, the beneficial effect of the product form on volatile perfume delivery is not known or appreciated. The present invention provides a dryer-added product that can deliver such a perfume benefit.

SUMMARY OF THE INVENTION

A first aspect of the invention provides a multi-use fabric conditioning composition comprising:

(a) a fabric conditioning component, (b) a carrier component;

(c) a blooming perfume composition comprising at least about 25%, at least about 35%, at least about 45%, at least about 55%, at least about 65%, by weight of said perfume composition, of blooming perfume ingredients having a boiling point equal or lower than about 250° C., and more preferably equal or lower than about 240° C., and wherein said multiple use fabric conditioning composition preferably comprises from about 0.05% to about 10%, by weight of the fabric conditioning composition, of said blooming perfume composition; and (d) an optional perfume component comprising at least one of:

(1) a perfume microcapsule, preferably a moisture-activated perfume microcapsule, comprising a perfume carrier and an encapsulated perfume composition, wherein said perfume carrier is preferably chosen from cyclodextrins, starch microcapsules, porous carrier microcapsule, and the like, and mixtures thereof; and wherein said encapsulated perfume composition comprises low volatile perfume ingredients, high volatile perfume ingredients, and mixtures thereof, and optionally but preferably said perfume composition comprises a blooming perfume;

(2) a pro-perfume;

(3) a low odor detection threshold perfume ingredients, wherein said low odor detection threshold perfume ingredients preferably comprise less than about 25%, by weight of the total neat perfume composition; and (4) mixtures thereof; and (e) an optional ingredient, preferably comprising at least one of: soil release agent, chelant, dye transfer inhibitor, dye fixative agent, chlorine scavenging agent, optical brightener, odor control agent, antimicrobial agent, fungicide, wrinkle control agent, anti-oxidant, preservative, insect repellent, moth repellent, processing agent, mold release agent, and mixtures thereof;

wherein preferably the weight ratio of said fabric conditioning component to said carrier component is from about 1:19 to about 19:1, and wherein preferably said fabric conditioning composition exhibits a melting point greater than about 90° C.

Another aspect of the present invention provides for a process of making a fabric conditioning composition comprising steps:

(a) melt mixing a fabric conditioning component, a carrier component, and a blooming perfume composition to form a molten fabric conditioning composition, wherein the blooming perfume composition is defined according to the first aspect of the invention; and (b) molding said molten fabric conditioning composition.

Another aspect of the present invention provides for a method of conditioning a fabric comprising the step of contacting said fabric with a fabric conditioning composition according to the previously described first aspect of the invention.

The multiple use fabric conditioning composition of the present invention is preferably operably connected to a composition carrier to form a multiple use fabric conditioning article. The fabric conditioning article is operably connectable to an inside surface of a clothes dryer. In a preferred embodiment, the article further comprises a docking member, wherein the composition carrier is operably connected to the docking member, and in turn, the docking member is operably connectable to the inside surface of a clothes dryer.

DETAILED DESCRIPTION OF THE INVENTION

It is now surprisingly discovered that some multiple use dryer-added fabric conditioning compositions can deliver a significantly higher level of volatile perfume ingredients than conventional dryer-added fabric conditioning products, such as dryer sheet products. Thus it is discovered that, when the same blooming perfume is incorporated at a same level to the, multiple use fabric conditioning composition of the present invention and to a conventional fabric conditioning composition that has a lower melting point and is coated to a substrate to form a dryer-added fabric conditioning sheet, the weight ratio of total blooming perfume ingredients vs. total substantive ingredients is significantly higher when the perfume is delivered from the multiple use fabric conditioning composition.

Blooming Perfume

In one embodiment, the multiple use fabric conditioning composition of the present invention comprises from about 0.05% to about 15%, preferably from about 0.1% to about 10%; more preferably from about 0.3% to about 6%, and even more preferably from about 0.5% to about 4%, by weight of the fabric conditioning composition, of a blooming perfume composition. The term "blooming perfume composition" as used herein means a perfume composition that comprises at least about 25%, at least about 35%, at least about 45%, at least about 55%, at least about 65%, by weight of the perfume composition, of blooming perfume ingredients, wherein the blooming perfume ingredients are those having a boiling point (B.P.) equal to or lower than about 250° C., more preferably equal to or lower than about 250° C., wherein the B.P. is measured at the normal standard pressure.

The boiling points of many perfume ingredients are given in, e.g., "Perfume and Flavor Chemicals (Aroma Chemicals)," S. Arctander, published by the author, 1969. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually at a pressure lower than the standard pressure (760 mm Hg), the boiling point at standard pressure can be approximately estimated by using boiling point-pressure nomographs, such as those given in "The Chemist's Companion," A. J. Gordon and R. A. Ford, John Wiley & Sons Publishers, 1972, pp. 30-36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306-316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301-310, and references cited therein, and "Predicting Physical Properties from Molecular Structure," R. Murugan et al, Chemtech, June 1994, pp. 17-23.

Non-limiting examples of blooming perfume ingredients that are useful in the multiple use conditioning compositions of the present invention are given in Table 1:

TABLE 1

Non-limiting Examples of Blooming Perfume Ingredients

| Perfume Ingredients | Approx. BP (° C.) |
|---|---|
| allo-Ocimene | 192 |
| Allyl Caproate | 185 |
| Allyl Heptoate | 210 |
| Amyl Acetate | 142 |
| Amyl Propionate | 161 |
| Anethol | 236 |
| Anisic Aldehyde | 248 |
| Anisole | 154 |
| Benzaldehyde | 179 |
| Benzyl Acetate | 215 |
| Benzyl Acetone | 235 |
| Benzyl Alcohol | 205 |
| Benzyl Butyrate | 240 |
| Benzyl Formate | 202 |
| Benzyl Iso Valerate | 246 |
| Benzyl Propionate | 222 |
| Beta Gamma Hexenol | 157 |
| Camphene | 159 |
| Camphor Gum | 208 |
| Carvacrol | 238 |
| laevo-Carveol | 227 |
| d-Carvone | 231 |
| laevo-Carvone | 230 |
| beta-Caryophyllene | 256 |
| Cinnamic Alcohol | 258 |
| Cinnamyl Formate | 250 |
| Citral (Neral) | 228 |
| Citronellol | 225 |
| Citronellyl Acetate | 229 |
| Citronellyl Isobutyrate | 249 |
| Citronellyl Nitrile | 225 |
| Citronellyl Propionate | 242 |
| Cuminic alcohol | 248 |
| Cuminic aldehyde | 236 |
| Cyclal C | 180 |
| Cyclohexyl Ethyl Acetate | 187 |
| Decyl Aldehyde | 209 |
| Dihydro Myrcenol | 208 |
| Dihydromyrcenyl Acetate | 225 |
| Dimethyl Benzyl Carbinol | 215 |
| Dimethyl Benzyl Carbinyl Acetate | 250 |
| Dimethyl Octanol | 213 |
| Diphenyl Oxide | 252 |
| Dodecalactone | 258 |
| Ethyl Acetate | 77 |
| Ethyl Aceto Acetate | 181 |
| Ethyl Amyl Ketone | 167 |
| Ethyl Benzoate | 212 |
| Ethyl Butyrate | 121 |
| Ethyl Hexyl Ketone | 190 |
| Ethyl Methyl Phenyl Glycidate | 260 |
| Ethyl Phenyl Acetate | 229 |
| Eucalyptol | 176 |
| Eugenol | 253 |
| Fenchyl Acetate | 220 |
| Fenchyl Alcohol | 200 |
| Flor Acetate (tricyclo Decenyl Acetate) | 175 |
| Frutene (tricyclo Decenyl Propionate) | 200 |
| gamma Methyl Ionone | 230 |
| gamma-n-Methyl Ionone | 252 |
| gamma-Nonalactone | 243 |
| Geraniol | 230 |
| Geranyl Acetate | 245 |
| Geranyl Formate | 216 |
| Geranyl Isobutyrate | 245 |
| Geranyl Nitrile | 222 |
| Hexenol | 159 |
| Hexenyl Acetate | 168 |
| cis-3-Hexenyl Acetate | 169 |
| Hexenyl Isobutyrate | 182 |
| cis-3-Hexenyl Tiglate | 101 |
| Hexyl Acetate | 172 |
| Hexyl Formate | 155 |
| Hexyl Neopentanoate | 224 |
| Hexyl Tiglate | 231 |

TABLE 1-continued

Non-limiting Examples of Blooming Perfume Ingredients

| Perfume Ingredients | Approx. BP (° C.) |
|---|---|
| Hydratropic Alcohol | 219 |
| Hydroxycitronellal | 241 |
| Indole | 254 |
| Isoamyl Alcohol | 132 |
| alpha-Ionone | 237 |
| beta-Ionone | 239 |
| gamma-Ionone | 240 |
| alpha-Irone | 250 |
| Isobornyl Acetate | 227 |
| Isobutyl Benzoate | 242 |
| Isobutyl Quinoline | 252 |
| Isomenthol | 219 |
| Isomenthone | 210 |
| Isononyl Acetate | 200 |
| Isononyl Alcohol | 194 |
| para-Isopropyl Phenylacetaldehyde | 243 |
| Isopulegol | 212 |
| Isopulegyl Acetate | 239 |
| Isoquinoline | 243 |
| cis-Jasmone | 248 |
| Lauric Aldehyde (Dodecanal) | 249 |
| Ligustral | 177 |
| Lilial (p-t-Bucinal) | 258 |
| d-Limonene | 177 |
| Linalool | 198 |
| Linalool Oxide | 188 |
| Linalyl Acetate | 220 |
| Linalyl Formate | 202 |
| Menthone | 207 |
| Menthyl Acetate | 227 |
| Methyl Acetophenone | 228 |
| Methyl Amyl Ketone | 152 |
| Methyl Anthranilate | 237 |
| Methyl Benzoate | 200 |
| Methyl Benzyl Acetate | 213 |
| Methyl Chavicol | 216 |
| Methyl Eugenol | 249 |
| Methyl Heptenone | 174 |
| Methyl Heptine Carbonate | 217 |
| Methyl Heptyl Ketone | 194 |
| Methyl Hexyl Ketone | 173 |
| alpha-iso "gamma" Methyl Ionone | 230 |
| Methyl-N-Methyl Anthranilate | 256 |
| Methyl Nonyl Acetaldehyde | 232 |
| Methyl Octyl Acetaldehyde | 228 |
| Methyl Phenyl Carbinyl Acetate | 214 |
| Methyl Salicylate | 223 |
| Myrcene | 167 |
| Neral | 228 |
| Nerol | 227 |
| Neryl Acetate | 231 |
| Nonyl Acetate | 212 |
| Nonyl Aldehyde | 212 |
| Octalactone | 230 |
| Octyl Alcohol (Octanol-2) | 179 |
| Octyl Aldehyde | 223 |
| Orange Terpenes (d-Limonene) | 177 |
| para-Cresol | 202 |
| para-Cresyl Methyl Ether | 176 |
| para-Cymene | 179 |
| para-Methoxy Acetophenone | 260 |
| para-Methyl Acetophenone | 228 |
| Phenoxy Ethanol | 245 |
| Phenyl Acetaldehyde | 195 |
| Phenyl Ethyl Acetate | 232 |
| Phenyl Ethyl Alcohol | 220 |
| Phenyl Ethyl Dimethyl Carbinol | 238 |
| Phenyl Heptanol | 261 |
| Phenyl Hexanol | 258 |
| alpha-Pinene | 157 |
| beta-Pinene | 166 |
| Prenyl Acetate | 155 |
| Propyl Butyrate | 143 |
| Pulegone | 224 |
| Rose Oxide | 182 |

TABLE 1-continued

Non-limiting Examples of Blooming Perfume Ingredients

| Perfume Ingredients | Approx. BP (° C.) |
|---|---|
| Safrole | 234 |
| alpha-Terpinene | 176 |
| gamma-Terpinene | 183 |
| 4-Terpinenol | 212 |
| alpha-Terpineol | 219 |
| Terpinolene | 184 |
| Terpinyl acetate | 220 |
| Tetrahydro Linalool | 191 |
| Tetrahydro Myrcenol | 208 |
| Tonalid | 246 |
| Undecenal | 223 |
| Veratrol | 206 |
| Verdox | 221 |
| Vertenex | 232 |
| Viridine | 221 |

Preferred blooming perfume ingredients that are useful in the multiple use conditioning compositions of the present invention include allo-ocimene, allyl caproate, allyl heptoate, amyl propionate, anethol, anisic aldehyde, anisole, benzaldehyde, benzyl acetate, benzyl acetone, benzyl alcohol, benzyl butyrate, benzyl formate, benzyl iso valerate, benzyl propionate, beta gamma hexenol, camphene, camphor, carvacrol, laevo-carveol, d-carvone, laevo-carvone, cinnamyl formate, citral (neral), citronellol, citronellyl acetate, citronellyl isobutyrate, citronellyl nitrile, citronellyl propionate, cuminic alcohol, cuminic aldehyde, Cyclal C, cyclohexyl ethyl acetate, decyl aldehyde, dihydro myrcenol, dimethyl benzyl carbinol, dimethyl benzyl carbinyl acetate, dimethyl octanol, diphenyl oxide, ethyl acetate, ethyl aceto acetate, ethyl amyl ketone, ethyl benzoate, ethyl butyrate, ethyl hexyl ketone, ethyl phenyl acetate, eucalyptol, eugenol, fenchyl acetate, fenchyl alcohol, flor acetate (tricyclo decenyl acetate), frutene (tricyclo decenyl propionate), gamma methyl ionone, gamma-n-methyl ionone, gamma-nonalactone, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, indole, isoamyl alcohol, alpha-ionone, beta-ionone, gamma-ionone, alpha-irone, isobornyl acetate, isobutyl benzoate, isobutyl quinoline, isomenthol, isomenthone, isononyl acetate, isononyl alcohol, para-isopropyl phenylacetaldehyde, isopulegol, isopulegyl acetate, isoquinoline, cis-jasmone, lauric aldehyde (dodecanal), Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, tonalid, undecenal, veratrol, verdox, vertenex, viridine, and mixtures thereof.

More preferred blooming perfume ingredients that are useful in the multiple use conditioning compositions of the present invention include allo-ocimene, allyl caproate, allyl heptoate, amyl propionate, anethol, anisole, benzaldehyde, benzyl acetate, benzyl acetone, benzyl alcohol, benzyl butyrate, benzyl formate, benzyl propionate, beta gamma hexenol, camphene, camphor, carvacrol, laevo-carveol, d-carvone, laevo-carvone, citral (neral), citronellol, citronellyl acetate, citronellyl nitrile, citronellyl propionate, cuminic aldehyde, Cyclal C, cyclohexyl ethyl acetate, decyl aldehyde, dihydro myrcenol, dimethyl benzyl carbinol, dimethyl octanol, ethyl acetate, ethyl aceto acetate, ethyl amyl ketone, ethyl benzoate, ethyl butyrate, ethyl hexyl ketone, ethyl phenyl acetate, eucalyptol, fenchyl acetate, fenchyl alcohol, flor acetate (tricyclo decenyl acetate), frutene (tricyclo decenyl propionate), gamma methyl ionone, gamma-nonalactone, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, isoamyl alcohol, alpha-ionone, beta-ionone, gamma-ionone, isobornyl acetate, isobutyl benzoate, isomenthol, isomenthone, isononyl acetate, isononyl alcohol, para-isopropyl phenylacetaldehyde, isopulegol, isopulegyl acetate, isoquinoline, Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, undecenal, veratrol, verdox, vertenex, viridine, and mixtures thereof.

In one embodiment, the blooming perfume compositions of the present invention comprises at least about 3 different blooming perfume ingredients, preferably at least about 4 different blooming perfume ingredients, more preferably at least about 5 different blooming perfume ingredients, and even more preferably at least about 6 different blooming perfume ingredients.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. For purposes of this invention, these materials are not counted as a "blooming perfume ingredient."

In order to better preserve the neat perfume from a potential heat degradation, due to the relative high temperature of the molten fabric conditioning composition of the present invention, and in order to avoid perfume loss due to the volatility of the blooming perfumes, it is preferable that the neat, free perfume composition is added to the molten fabric conditioning composition as late as possible before the resulting molten fabric conditioning mixture is charged into the molds.

Following is a non-limiting exemplary blooming perfume composition of the present invention:

| Perfume A | |
|---|---|
| Perfume Ingredients | Wt. % |
| Benzyl acetate | 3 |
| Benzyl salicylate | 5 |
| Cedrenone | 3 |
| Cedrenyl acetate | 3 |
| Coumarin | 3 |
| Dihydro myrcenol | 5 |
| Ethyl maltol | 3 |
| Ethylene brassylate | 5 |
| Eugenol | 3 |
| Galaxolide | 6 |
| Hexyl cinnamic aldehyde | 5 |
| Lilial | 8 |
| d-Limonene | 20 |
| Linalool | 8 |
| Gamma Methyl Ionone | 5 |
| Patchouli alcohol | 3 |
| Phenyl ethyl alcohol | 10 |
| Alpha Pinene | 2 |
| Total | 100 |

Substantive perfume ingredients, which can be used as part of blooming perfume compositions in multiple use conditioning compositions of the present invention, are those having a B.P. higher than about 250° C. Non-limiting examples of such perfume ingredients include allyl cyclohexane propionate, ambrettolide, amyl benzoate, amyl cinnamate, amyl cinnamic aldehyde, amyl cinnamic aldehyde dimethyl acetal, iso-amyl salicylate, aurantiol, benzophenone, benzyl salicylate, cadinene, cedrenone, cedrenyl acetate, cedrol, cedryl acetate, cinnamyl cinnamate, coumarin, cyclohexyl salicylate, cyclamen aldehyde, dihydro isojasmonate, diphenyl methane, ethylene brassylate, ethyl maltol, ethyl methyl phenyl glycidate, ethyl undecylenate, iso-eugenol, exaltolide, galaxolide, geranyl anthranilate, hexadecanolide, hexenyl salicylate, hexyl cinnamic aldehyde, hexyl salicylate, linalyl benzoate, 2-methoxy naphthalene, methyl cinnamate, methyl dihydrojasmonate, beta-methyl naphthyl ketone, musk indanone, musk ketone, musk tibetine, myristicin, delta-nonalactone, oxahexadecanolide-10, oxahexadecanolide-11, patchouli alcohol, phantolide, phenyl ethyl benzoate, phenylethylphenylacetate, alpha-santalol, thibetolide, delta-undecalactone, gamma-undecalactone, vanillin, vetiveryl acetate, yara-yara, and mixtures thereof.

Another aspect of the invention provides for a multiple use fabric conditioning composition to comprise an optional perfume component comprising at least one of: (a) a perfume microcapsule comprising a perfume carrier and an encapsulated perfume composition; (b) a pro-perfume; (c) a low odor detection threshold perfume ingredients; and (d) mixtures thereof.

Perfume Microcapsules

In one optional but preferred embodiment of the present invention, the multiple use fabric conditioning composition of the present invention can comprise a perfume microcapsule comprising a perfume carrier and an encapsulated perfume composition, to provide a long lasting perfume benefit on fabric and/or to reduce the perfume odor intensity of the multiple use fabric conditioning composition.

In one embodiment of the present invention, in addition to the neat blooming perfume composition, a portion of said blooming perfume composition or a different perfume composition is encapsulated in one or more types of perfume carriers to comprise a perfume microcapsule, preferably a moisture-activated perfume microcapsule. Non-limiting examples of moisture-activated perfume carriers include, e.g., cyclodextrins, starch capsules, porous carriers such as zeolites, and mixtures thereof. Thus, the perfume can be encapsulated in the form of, e.g., the following: molecular encapsulation, such as inclusion in a complex with a cyclodextrin, coacevate microencapsulation wherein a perfume droplet is enclosed in a solid wall material, "cellular matrix" encapsulation wherein perfume micro droplets are stably held in cells of solid micro particles, or perfume embedded in, e.g., starch or sugar matrix, and mixtures thereof, wherein the encapsulated perfume composition can contain substantive perfume ingredients, blooming perfume ingredients, and mixtures thereof, and wherein the neat, free perfume can be any suitable perfume, preferably a blooming perfume composition. There are however, perfume characteristics which are preferred for use on fabrics to provide, e.g., a fresh fabric impression. Non-limiting preferred perfume ingredients for use in the neat perfume and/or encapsulated perfume herein are given in U.S. Pat. No. 5,714,137, issued Feb. 3, 1998 to Trinh et al.

Cyclodextrin. A preferred moisture-activated perfume carrier that is useful in the multiple use fabric conditioning composition of the present invention is cyclodextrin. As used herein, the term "cyclodextrin" includes any of the known cyclodextrins such as unsubstituted cyclodextrins containing from six to twelve glucose units, especially beta-cyclodextrin, gamma-cyclodextrin, alpha-cyclodextrin, and/or derivatives thereof, and/or mixtures thereof. A more detailed description of the cyclodextrins that are useful for use in the present invention is given in U.S. Pat. No. 5,714,137, issued Feb. 3, 1998 to Trinh et al. Preferred cylodextrins herein include beta-cyclodextrin, gamma-cyclodextrin, alpha-cyclodextrin, substituted beta-cyclodextrins, and mixtures thereof, the most preferred being beta-cyclodextrin. Perfume molecules are encapsulated into the cavity of the cyclodextrin molecules to form molecular microcapsules, commonly referred to as cyclodextrin/perfume complexes. The perfume loading in a cyclodextrin/perfume complexe is typically from about 3% to about 20%, preferably from about 5% to about 18%, more preferably from about 7% to about 16%, by weight of the cyclodextrin/perfume complex.

The cyclodextrin/perfume complexes hold the encapsulated perfume molecules tightly, so that they can prevent perfume diffusion and/or perfume loss, and thus reducing the odor intensity of the multiple use fabric conditioning composition. However, the cyclodextrin/perfume complex can readily release some perfume molecules in the presence of moisture, thus providing a long lasting perfume benefit. Non-limiting examples of preparation methods are given in U.S. Pat. No. 5,552,378, issued Sep. 3, 1996 to Trinh et al., and U.S. Pat. No. 5,348,667, issued to Bacon et al.

Cyclodextrin/perfume complexes (or perfume cyclodextrin microcapsule) useful in the present invention preferably have small particle size, typically less than about 200 micrometer, preferably less than about 150 micrometer, more preferably less than about 100 micrometer, and even more preferably less than about 50 micrometer.

The multiple use fabric conditioning composition of the present invention comprises of from about 0.1% to about 25%, preferably from about 1% to about 20%, more preferably from about 3% to about 15%, and more preferably from about 5% to about 10%, by weight of the total fabric conditioning composition, of cyclodextrin/perfume complex.

Moisture-Activated Cellular Matrix Microcapsule Moisture-activated and/or water-soluble perfume cellular matrix microcapsules are solid particles containing perfume stably held in the cells within the particles. Details about moisture-activated perfume cellular matrix microcapsules are disclosed in PCT Publication WO 01/85888 published Nov. 15, 2001 and U.S. Pat. No. 3,971,852 issued Jul. 27, 1976 to Benner et al. A preferred moisture-activated perfume cellular matrix microcapsule is perfume starch microcapsule which uses starch as the cellular matrix material.

Moisture-activated perfume cellular matrix microcapsules preferably have size of from about 0.5 micron to about 300 microns, more preferably from about 1 micron to about 200 microns, most preferably from about 2 microns to about 100 microns. The preferred perfume loading in the cellular matrix microcapsules useful in the present invention ranges from about 20% to about 70%, more preferably from about 40% to about 60%, by weight of the microcapsules. Sufficient amount of perfume moisture-activated microcapsules should be used to deliver the desired levels of perfume, depending on the perfume loading of the microcapsules. For microcapsules with a perfume loading of about 50%, typical level of the matrix microcapsules is from about 0.1% to about 15%, preferably from about 0.5% to about 7%, more preferably from about 0.8% to about 8%, and even more preferably from about 1% to about 6%, by weight of the multiple use fabric conditioning composition.

It is preferable to use a suitable dispersing agent to distribute the moisture-activated perfume cellular matrix microcapsules uniformly in the molten multiple use fabric conditioning composition. A preferred dispersing agent for use in combination with moisture-activated cellular microcapsules of the present invention is block copolymer having blocks of terephthalate and polyethylene oxide. More specifically, these polymers are comprised of repeating units of ethylene and/or propylene terephthalate and polyethylene oxide terephthalate at a molar ratio of poly(ethylene/propylene) terephthalate units to polyethylene oxide terephthalate units of from about 25:75 to about 35:65, said polyethylene oxide terephthalate containing polyethylene oxide blocks having molecular weights of from about 300 to about 2,000. The molecular weight of this polymeric dispersing agent is in the range of from about 5,000 to about 55,000.

Another preferred dispersing agent for use in combination with moisture-activated cellular microcapsules of the present invention is block copolymer having blocks of polyethylene oxide and of polypropylene oxide. Nonlimiting examples of dispersing agent of this type include Pluronic surfactants and Tetronic surfactants. Pluronic surfactants have the general formula $H(EO)_n(PO)_m(EO)_nH$, wherein EO is an ethylene oxide group, PO is a propylene oxide group, and n and m are numbers that indicate the average number of the groups in the surfactants. Non-limiting, typical examples of suitable Pluronic® surfactants are:

| Name | Average MW | Average n | Average m |
|---|---|---|---|
| L-101 | 3,800 | 4 | 59 |
| L-81 | 2,750 | 3 | 42 |
| L-44 | 2,200 | 10 | 23 |
| L-43 | 1,850 | 6 | 22 |
| F-38 | 4,700 | 43 | 16 |
| P-84 | 4,200 | 19 | 43, |

and mixtures thereof.

Tetronic® surfactants have the general formula:

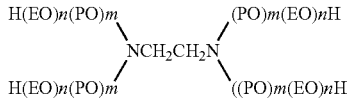

wherein EO, PO, n, and m have the same meanings as above. Non-limiting typical examples of suitable Tetronic surfactants are:

| Name | Average MW | Average n | Average m |
|---|---|---|---|
| 901 | 4,700 | 3 | 18 |
| 908 | 25,000 | 114 | 22, |

and mixtures thereof.

In the process of preparing a multiple use fabric conditioning bar, a suitable dispersing agent is first added to the fabric conditioning composition melt mixture with mixing, and the moisture-activated perfume starch microcapsules are then added to the melt mixture with mixing, and the resulting mixture is poured into a mold to form a multiple use fabric conditioning bar.

Porous Carrier Microcapsule. A portion of the blooming perfume composition or another perfume composition can also be absorbed onto and/or into a porous carrier, such as zeolites or clays, to form perfume porous carrier microcapsules in order to reduce the amount of free perfume in the multiple use fabric conditioning composition of the present invention. When the perfume is to be adsorbed onto zeolite, the perfume ingredients forming the encapsulated perfume composition can be selected according to the description provided in U.S. Pat. No. 5,955,419 issued Sep. 21, 1999, to Barket, Jr., et al. Preferred perfume ingredients that are suitable for use with porous mineral carrier materials, such as clays and zeolites or clays, particularly dehydrated/activated zeolites, are those that do not comprises a high level of unstable perfume ingredients that degrade upon incorporation into said porous mineral carrier material. Non-limiting examples of such preferred perfume ingredients are given in U.S. Pat. Appl. Publ. No. 2003/0013632 A1 published Jan. 16, 2003 to Santos et al.

Pro-perfume. The blooming perfume composition of the present invention can additionally include a pro-perfume. The term "pro-perfume" is herein defined to include: pro-fragrances, pro-perfumes, pro-accords, and mixtures thereof. Such pro-perfume may include acetal pro-perfumes, ketal pro-perfumes, ester pro-perfumes (e.g., digeranyl succinate), hydrolyzable inorganic-organic pro-perfumes, and mixtures thereof. These pro-perfumes are generally nonvolatile materials that release or convert to a perfume material, preferably a blooming perfume ingredient, as a result of, e.g., simple hydrolysis, or may be pH-change-triggered pro-perfumes (e.g. triggered by a pH drop) or may be enzymatically releasable pro-perfumes, or light-triggered pro-perfumes. The pro-perfumes of the present invention can exhibit varying release rates depending upon the pro-perfume chosen. Pro-perfumes for use in the compositions of the present invention are suitably described in the following: U.S. Pat. No. 5,378,468, Suffis et al., issued Jan. 3, 1995; U.S. Pat. No. 5,626,852, Suffis et al., issued May 6, 1997; U.S. Pat. No. 5,710,122, Sivik et al., issued Jan. 20, 1998; U.S. Pat. No. 5,716,918, Sivik et al., issued Feb. 10, 1998; U.S. Pat. No. 5,721,202, Waite et al., issued Feb. 24, 1998; U.S. Pat. No. 5,744,435, Hartman et al., issued Apr. 25, 1998; U.S. Pat. No. 5,756,827, Sivik, issued May 26, 1998; U.S. Pat. No. 5,830,835, Severns et al., issued Nov. 3, 1998; U.S. Pat. No. 5,919,752, Morelli et al., issued Jul. 6, 1999; WO 00/02986 published Jan. 20, 2000, Busch et al.; and WO 01/04248 published Jan. 18, 2001, Busch et al.

Low odor detection threshold perfume ingredient. The blooming perfume composition of the present invention can also comprise some low odor detection threshold perfume ingredients. As used herein, the "odor detection threshold" of a perfume ingredient is the lowest vapor concentration of that perfume ingredient which can be olfactorily detected. The odor detection threshold and some odor detection threshold values are discussed in, e.g., "Standardized Human Olfactory Thresholds", M. Devos et al, IRL Press at Oxford University Press, 1990, and "Compilation of Odor and Taste Threshold Values Data", F. A. Fazzalari, editor, ASTM Data Series DS 48A, American Society for Testing and Materials, 1978, both of said publications being incorporated by reference. The use of small amounts of low odor detection threshold perfume ingredients may improve perfume odor character while minimizing the effect of the perfume on the release of the fabric conditioning composition of the present invention. Non-limiting examples of low odor detection threshold perfume ingredients are given in PCT Publication WO 01/85888 published Nov. 15, 2001. These low odor detection threshold perfumes are preferably present at low levels in addition to the blooming perfume ingredients, typically less than about 20%, preferably less than about 15%, more preferably less than about 10%, by weight of the total neat and/or encapsulated perfume compositions of the multiple use fabric conditioning composition. It is understood that these materials can be used a levels higher than 20% and even up to 100% of the total perfume composition. Some blooming perfume ingredients also have low odor detection threshold. For purpose of the present invention, these materials are counted as a "blooming perfume ingredient."

Fabric Conditioning Component

In addition to the blooming perfume composition, the multiple use fabric conditioning composition of the present invention comprises a fabric conditioning component and a carrier component. The fabric conditioning component provides fabric softening properties to laundry. The fabric conditioning component can additionally impart antistatic properties to the laundry. Exemplary components that can be used as the fabric conditioning component include fabric softening ingredients that are commonly used in the fabric care compositions to provide fabric softening properties. The carrier component mixes with the fabric conditioning component and helps the fabric conditioning component resist transfer to laundry by melting during the drying operation.

The carrier component is chosen so that the fabric conditioning composition exhibits a melting point or softening point that is above the operating temperature of the dryer. In most dryer operations, this means that the melting temperature of the fabric conditioning composition is above about 90° C. The melting temperature or the softening temperature of the fabric conditioning composition can be above about 95° C., above about 100° C., above about 110° C., or above about 120° C. The melting temperature of the fabric conditioning composition can be below 200° C.

The melting temperature of the fabric conditioning composition refers to the temperature at which the composition begins to flow under its own weight. As the fabric conditioning composition reaches its melting point, one will observe the composition undergoing a transfer from a solid discreet mass to a flowable liquid. Although a differential scanning calorimeter (DSC) measurement of the composition may reveal that certain portions or phases of the composition may exhibit melting at temperatures that are within the operating temperatures of a dryer, it should be understood that what is meant by the melting temperature of the composition is not the melting temperature of certain portions or phases within the composition, but the melting temperature of the composition as demonstrated by the composition being visibly observed as a flowable liquid. It is expected that the fabric conditioning composition may be provided as a solid mixture including multiple phases or as a solid solution including a single phase.

The softening temperature of the composition refers to the temperature at which the solid mass becomes easily deformable. For many exemplary compositions according to the invention, it is expected that the softening temperature will be a few degrees below the melting temperature.

The fabric conditioning component can include any fabric conditioning active, that when melt mixed with the carrier component to, provides a fabric conditioning composition exhibiting a desired melting temperature of greater than about 90° C., and that provides fabric softening properties to laundry as a result of its presence in the fabric conditioning composition when used during the operation of drying wet laundry in a dryer. Exemplary components that can be used as the fabric conditioning component include those fabric softening actives that are commonly used in the laundry drying process to provide fabric softening properties.

A general type of fabric conditioning active that can be used according to the present invention can be referred to as quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having at least one alkyl group containing between 6 and 24 carbon atoms. Exemplary alkylated quaternary ammonium compounds include dialkyl dimethyl quaternary ammonium compounds, monoalkyl trimethyl quaternary ammonium compounds, and monomethyl trialkyl quaternary ammonium compounds. Preferred alkylated quaternary ammonium compounds comprise a high level of dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, a benzyl group, an alkyl ether propyl group, hydrogenated-tallow group, coco group, stearyl group, palmityl group, and soya group. A preferred alkyl group is straight chain, saturated $C_{12}$-$C_{22}$ group, more preferably $C_{14}$-$C_{22}$ group. Non-limiting examples of preferred straight chain, saturated alkyl group include stearyl group, hydrogenated tallow alkyl group, and mixtures thereof. Exemplary ring or cyclic quaternary ammonium compounds include imidazolinium quaternary ammonium compounds and are available under the name Varisoft®. Exemplary imidazolinium quaternary ammonium compounds include methyl-1hydrogenated tallow amido ethyl-2-hydrogenated tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis (2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyldialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Varisoft®. Non-limiting exemplary amidoamine quaternary ammonium compounds that can be used according to the present invention are methyl-bis(hydrogenated tallow amidoethyl)-2-hydroxyethyl ammonium methyl sulfate, methyl bis (tallowamidoethyl)-2-hydroxyethyl ammonium methyl sulfate, and methyl bis (stearoylamidoethyl)-2-hydroxyethyl ammonium methyl sulfate. Non-limiting exemplary ester quaternary compounds are methyl bis (stearoyloxyethyl)-2-hydroxyethyl ammonium methyl sulfate, dimethyl bis (stearoyloxyethyl) ammonium methyl sulfate, methyl bis (hydrogenated tallowoyloxyethyl)-2-hydroxyethyl ammonium methyl sulfate, and mixtures thereof.

Other quaternary ammonium compounds that can be used in the composition of the present invention are disclosed, e.g., in U.S. Pat. Appl. Publ. No. 2003/0195130 A1 published Oct. 16, 2003 to Lentsch et al., and U.S. Pat. No. 6,107,270 issued Aug. 22, 2000 to Smith et al.

The quaternary ammonium compounds can include any counter ion that allows the component to be used in a manner that imparts fabric-softening properties according to the present invention. Exemplary counter ions include chloride, methyl sulfate, ethyl sulfate, and sulfate. However, chloride ion is sometimes less preferred due to its tendency to cause rust of the steel dryer drums. Quaternary ammonium compounds that can be used as fabric conditioning components can be available as relatively pure or concentrated quaternary ammonium compounds or they can be provided in a medium. Exemplary mediums include solvents and/or surfactants. When the quaternary ammonium compounds are provided in a medium, they can be provided in the medium in an amount of between at least about 50 wt. %, or between about 50 wt. % and about 99 wt. %, or between about 70 wt. % and about 95 wt. %, or between about 75 wt. % and about 90 wt. %. Exemplary mediums for the quaternary ammonium compounds include alcohols, glycols, nonionics, fatty alcohols, fatty acids, triglycerides, and solid esters. An exemplary alcohol that can be used is isopropanol. Exemplary glycols that can be used include hexylene glycol and propylene glycol. Exemplary nonionics include ethoxylated alcohols. Exemplary fatty alcohols include stearyl alcohols. Exemplary fatty acids include hard tallow acids and stearic acid. Exemplary triglycerides include hydrogenated tallow. Exemplary solid esters include stearyl stearate. A preferred fabric conditioning component for use in the present invention is Varisoft DS-110™ which comprises about 70% methyl bis (hydrogenated tallowamidoethyl)-2-hydroxyethyl ammonium methyl sulfate and about 30% of an ethoxylated fatty acid surfactant, and is available from Goldschmidt Chemical Company, Janeville, Wis.

Carrier Component

The carrier component of the fabric conditioning composition can be any component that helps contain the fabric conditioning component within the composition, allows the fabric conditioning component to transfer to wet laundry, and provides the fabric conditioning composition with a melting temperature or a softening temperature that is greater than the operating temperature of the dryer. Exemplary carrier components that can be used according to the invention include ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof.

Exemplary ethylene bisamides include those having the following formula: 1

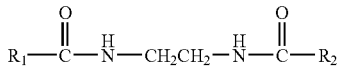

wherein $R_1$ and $R_2$ are alkyl groups containing at least 6 carbon atoms, and can be straight or branched, saturated or unsaturated, cyclic or noncyclic, and can include ethylene oxide groups and/or propylene oxide groups. $R_1$ and $R_2$ can be $C_6$-$C_{24}$ alkyl groups. $R_1$ and $R_2$ can be the same or different. Exemplary ethylene bisamides include ethylene bisteramide, ethylene bisoleamide, and ethylene bisbehenamide. A preferred ethylene bisamide is Acrawax C™ which comprises N,N'-ethylene bis-stearamide, and is available from IMS Company, Chagrin Falls, Ohio.

Exemplary primary alkylamides include those having the following formula: 2:

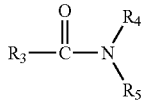

wherein $R_3$ is a $C_6$-$C_{24}$ alkyl group that may be straight or branched, saturated or unsaturated, cyclic or noncyclic, and $R_4$ and $R_5$ can be hydrogen or $C_1$-$C_{24}$ alkyl groups that are straight or branched, saturated or unsaturated, cyclic or noncyclic. $R_4$ and $R_5$ can be the same or different. An exemplary primary alkylamide is stearamide.

Exemplary alkanolamides include those having the following formula: 3:

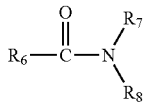

wherein $R_6$ is a $C_6$-$C_{24}$ alkyl group that may be straight or branched, saturated or unsaturated, cyclic or noncyclic. $R_7$ and $R_8$ can be the same or different. When they are different, one can be hydrogen and the other can be an alkanol group such as $C_2H_{40}H$ or $C_3H_{60}H$. When they are the same, they can each be an alkanol group such as $C_2H_{40}H$ or $C_3H_6OH$.

Exemplary alcohols include those having the following formula: $R_9$—OH, wherein $R_9$ is a $C_{12}$ to $C_{24}$ alkyl group that can be straight or branched, saturated or unsaturated, cyclic or noncyclic. Exemplary alcohols include stearyl alcohol and behenyl alcohol. Exemplary alkoxylated alcohols include those having the formula: $R_{10}$—$O(AO)_x$, wherein $R_{10}$ is a $C_{12}$-$C_{24}$ alkyl group that is straight or branched, saturated or unsaturated, cyclic or noncyclic, and AO is an ethylene oxide or propylene oxide group, and x is a number from 1 to 100.

The fabric conditioning composition can be prepared by mixing the fabric conditioning component and the carrier component and any optional ingredients at a temperature sufficient to melt all the components. The step of mixing preferably takes place at a temperature in excess of about 100° C. In general, the components should not be mixed at a temperature that is so high that it harms or discolors the components of the composition. For many components of the fabric conditioning composition, the mixing temperature can be less that about 180° C. An exemplary range for mixing is from about 120° C. to about 150° C. In order to better preserve the perfume from a potential heat degradation, due to the relative high temperature of the molten fabric conditioning composition of the present invention during manufacturing, it is preferable that the neat, non-encapsulated perfume composition, such as a low volatile perfume composition, is added to the molten fabric conditioning composition as late as possible before the resulting molten fabric conditioning mixture is extruded or molded. Furthermore, in order to reduce possible degradation from the effect of high heat and oxidation, the molten components and molten composition are preferably processed, e.g., heated, mixed, and/or molded, under a headspace or a blanket of nitrogen.

Once the components are sufficiently mixed, the composition is shaped to provide a desired form. The form can be provided as a solid unitary structure. Exemplary forms include blocks or strips that can be placed within a drying machine so that a surface of the fabric conditioning composition is exposed to laundry during the drying operation. Exemplary forms include a rectangular block and a rectangular strip. Additional forms include half-cylindrical shapes with the exposed surfaces and edges being curved or rounded for better dispensing. The fabric conditioning composition can be provided having a size of at least about 5 grams. When the fabric conditioning composition is provided having a size of at least about 5 grams, it is expected that it will provide fabric softening and/or antistatic properties for laundry in multiple cycles of a dryer. An exemplary size is about 30 g to about 170 g. The fabric conditioning component and the carrier component can be mixed together to provide a fabric conditioning composition that releases a desired amount of fabric conditioning component during the drying cycle when placed inside of a dryer. An exemplary weight ratio of fabric conditioning component to carrier component is from about 1:19 to about 19:1. The ratio of the fabric conditioning component to the carrier component can be from about 1:10 and about 10:1, and can be from about 3:7 and about 9:1. It should be understood that the reference to the fabric conditioning component refers to the material responsible for providing fabric-softening properties, and is not meant to include the medium that may be present with the fabric conditioning component. That is, the fabric conditioning component may be commercially available in a medium that can be a solvent or a surfactant. Furthermore, the medium can be the same as or different from the carrier component.

Optional Ingredients. The composition of the present invention can contain effective amounts of optional ingredients, such as, soil release agent, chelant, dye transfer inhibitor, dye fixative agent, chlorine scavenging agent, optical brightener, odor control agent, antimicrobial agent, fungicide, wrinkle control agent, anti-oxidant, preservative, plasticizer, insect repellent, moth repellent, processing aid, mold release agent, and mixtures thereof. Preferred soil release polymers, chelants, dye transfer inhibitors, dye fixatives, chlorine scavengers, and anti-oxidants are given in U.S. Pat. No. 6,046,154, issued on Apr. 4, 2000 to Trinh et al. and references cited therein. Preferred odor control agents (such as cyclodextrins, metal salts, and zeolites), wrinkle control agents, antimicrobial agents, fungicides, preservatives, insect repellents, and moth repellents are given in U.S. Pat. No. 5,968,404, issued Oct. 19, 1999 to Trinh et al. and references cited therein.

Processing Agent. A non-limiting example of processing agent is hydrocarbon polymers, such as Vybar 103 polymer, available from Baker Petrolite Polymers Division of Baker Hughes, Sand Springs, Okla. This hydrocarbon polymer helps to eliminate bubbles, mottling and acts as a perfume binder.

The fabric conditioning composition can be operably connected the inside surface of a tumble dryer, e.g., on a dryer fin (or baffle) of a dryer so that the composition contacts the wet laundry during the drying operation. The composition can be attached to the inside of the dryer, e.g., by a cradle such as the cradle disclosed by U.S. Patent Publication Ser. No. 2003/0192197.

During the drying cycle, the fabric conditioning composition should release a sufficient amount of the fabric conditioning composition to provide a desired level of softening and freshening properties and, if desired, antistatic properties. In addition, the fabric conditioning composition should not release too much of the fabric conditioning component that would result in spotting of the laundry. It is expected that during the drying cycle, the fabric conditioning composition will release between about 0.01 to about 1 gram of the fabric conditioning composition per pound of dry laundry. The amount released per drying cycle can be from about 0.02 to 0.75 gram of the fabric conditioning composition per pound of dry laundry, and can be from about 0.05 to 0.50 gram of fabric conditioning composition per pound of dry laundry. It should be understood that the size of the dryer and the size of the fabric conditioning composition can vary for different types of dryers and drying conditions. For example, there are various sizes of dryers that are commonly used in industrial laundry facilities and in residential or consumer environments.

The term "multiple use" means the multiple use fabric conditioning composition of the present invention can be used to deliver a desired amount of fabric conditioning active to laundry during at least two cycles, preferably at least about 10 cycles, more preferably at least about 20 cycles, even more preferably at least about 30 cycles, yet more preferably at least about 40 cycles, and again even more preferably at least about 50 cycles, before the fabric conditioning composition needs to be replaced for drying laundry before it needs to be replaced. It should be understood that the term "laundry" refers to any textile or fabric material that is laundered.

The dryers in which the multiple use fabric conditioning composition according to the invention can be used include any type of automatic clothes dryer that uses heat and agitation to remove water from the laundry. An exemplary dryer includes a tumble-type dryer that is heated by electricity or gas, wherein the laundry is provided within a rotating drum that causes the laundry to tumble during the operation of the dryer.

Examples of suitable fabric conditioning compositions include those described at paragraphs [0029] to [0051] of U.S. patent application U.S. 2003/0195130, wherein the perfume used is Perfume A given hereinabove.

The following are more non-limiting examples of the instant composition.

| Ingredients | Example 1 Wt. % | Example 2 Wt. % | Example 3 Wt. % |
|---|---|---|---|
| Acrawax C[(a)] | 51 | 47.6 | 47 |
| Varosoft DS-110[(b)] | 45.5 | 45.7 | 45.3 |
| Vybar 103 | 2 | — | — |
| Perfume A | 2.5 | — | 1 |
| Cyclodextrin/Perfume Complex[(c)] | — | 6.7 | 6.7 |
| Total | 100 | 100 | 100 |

[(a)]Ethylene bis-stearamide

[(b)]Comprising about 70% methyl bis-(hydrogenated tallow amidoethyl) 2-hydroxyethyl ammonium methyl sulfate and about 30% alkyl ethoxylate, available from Goldschmidt Chemical Corporation, Janesville, Wisconsin.

[(c)]Perfume complex of beta-cyclodextrin.

| Ingredients | Example 4 Wt. % | Example 5 Wt. % | Example 6 Wt. % |
|---|---|---|---|
| Acrawax C | 48 | 50 | 40 |
| Varosoft DS-110 | 45 | 44 | 53 |
| Vybar 103 | 2 | — | — |
| Perfume A | — | 1 | 2 |
| Perfume starch microcapsules | 3 | 3 | — |
| Polyethylene/polypropylene terephthalate - polyethylene oxide block copolymer | 2 | 2 | — |
| Cyclodextrin(d) | — | — | 5 |
| Total | 100 | 100 | 100 |

(d)Uncomplexed beta-cyclodextrin, with particle size of less than about 20 micrometer. In Examples 4 and 5, the poly(ethylene/propylene) terephthalate - polyethylene oxide terephthalate block copolymer is added to the softener melt mixture with mixing, before the starch microcapsules are added to the mixture with mixing, and the resulting mixture is poured into a mold to form a multiple use fabric conditioning bar.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

Except as otherwise noted, the articles "a," "an," and "the" mean "one or more."

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multiple-use fabric conditioning composition comprising:

(a) a fabric conditioning component;

(b) a non-sheet form carrier component; and (c) a non-encapsulated blooming perfume composition, free of a perfume carrier, comprising at least about 65%, by weight of said perfume composition, of at least three different blooming perfume ingredients having a boiling point equal or lower than 240° C.; and (d) perfume starch microcapsules, and;

(e) polyethylene/polypropylene terephthalate—polyethylene oxide block copolymer dispersing agent for said microcapsules;

wherein the composition is in the form of a solid, unitary structure that can deliver said composition to fabrics during at least 10 dryer cycles and is operably connectable to an inside surface of a clothes dryer.

2. The fabric conditioning composition of claim 1, wherein said fabric conditioning composition exhibits a melting point greater than 90° C.

3. The composition of claim 2, wherein said composition is a result of melt mixing said fabric conditioning component, said carrier component, and said blooming perfume composition.

4. The composition of claim 3, wherein the weight ratio of said fabric conditioning component to said carrier component is from about 1:19 to about 19:1.

5. The composition of claim 1, wherein the blooming perfume composition comprises at least six different perfume ingredients.

6. The composition of claim 1, wherein said blooming perfume composition comprises of at least about 35%, by weight of said perfume composition, of perfume ingredients having a boiling point equal or lower than about 240° C.

7. The composition of claim 6, wherein said blooming perfume composition comprises of at least about 45%, by weight of said perfume composition, of perfume ingredients having a boiling point equal or lower than about 240° C.

8. The composition of claim 1, wherein said blooming perfume ingredient is chosen from the group consisting of allo-ocimene, allyl caproate, allyl heptoate, amyl propionate, anethol, anisic aldehyde, anisole, benzaldehyde, benzyl acetate, benzyl acetone, benzyl alcohol, benzyl butyrate, benzyl formate, benzyl iso valerate, benzyl propionate, beta gamma hexenol, camphene, camphor, carvacrol, laevo-carveol, d-carvone, laevo-carvone, cinnamyl formate, citral (neral), citronellol, citronellyl acetate, citronellyl isobutyrate, citronellyl nitrile, citronellyl propionate, cuminic alcohol, cuminic aldehyde, Cyclal C, cyclohexyl ethyl acetate, decyl aldehyde, dihydro myrcenol, dimethyl benzyl carbinol, dimethyl benzyl carbinyl acetate, dimethyl octanol, diphenyl oxide, ethyl acetate, ethyl aceto acetate, ethyl amyl ketone, ethyl benzoate, ethyl butyrate, ethyl hexyl ketone, ethyl phenyl acetate, eucalyptol, eugenol, fenchyl acetate, fenchyl alcohol, for acetate (tricyclo decenyl acetate), frutene (tricyclo decenyl propionate), gamma methyl ionone, gamma-n-methyl ionone, gamma-nonalactonc, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, indole, isoamyl alcohol, alpha-ionone, beta-ionone, gamma-ionone, alpha-irone, isobornyl acetate, isobutyl benzoate, isobutyl quinoline, isomenthol, isomenthone, isononyl acetate, isononyl alcohol, para-isopropyl phenylacetaldehyde, isopulegol, isopulegyl acetate, isoquinoline, cis-jasmone, lauric aldehyde (dodecanal), Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, tonalid, undecenal, veratrol, verdox, vertenex, viridine, and a mixture thereof.

9. The composition of claim 8, wherein said blooming perfume ingredient is chosen from the group consisting of allo-ocimene, allyl caproate, allyl heptoate, amyl propionate, anethol, anisole, benzaldehyde, benzyl acetate, benzyl acetone, benzyl alcohol, benzyl butyrate, benzyl formate, benzyl propionate, beta gamma hexenol, camphene, camphor, carvacrol, laevo-carveol, d-carvone, laevo-carvone, citral (neral), citronellol, citronellyl acetate, citronellyl nitrile, citronellyl propionate, cuminic aldehyde, Cyclal C, cyclohexyl ethyl acetate, decyl aldehyde, dihydro myrcenol, dimethyl benzyl carbinol, dimethyl octanol, ethyl acetate, ethyl aceto acetate, ethyl amyl ketone, ethyl benzoate, ethyl butyrate, ethyl hexyl ketone, ethyl phenyl acetate, eucalyptol, fenchyl acetate, fenchyl alcohol, flor acetate (tricyclo decenyl acetate), frutene (tricyclo decenyl propionate), gamma methyl ionone, gamma-nonalactone, geraniol, geranyl acetate, geranyl formate, geranyl isobutyrate, geranyl nitrile, hexenol, hexenyl acetate, cis-3-hexenyl acetate, hexenyl isobutyrate, cis-3-hexenyl tiglate, hexyl acetate, hexyl formate, hexyl neopentanoate, hexyl tiglate, hydratropic alcohol, hydroxycitronellal, isoamyl alcohol, alpha-ionone, beta-ionone, gamma-ionone, isobornyl acetate, isobutyl benzoate, isomenthol, isomenthone, isononyl acetate, isononyl alcohol, para-isopropyl phenylacetaldehyde, isopulegol, isopulegyl acetate, isoquinoline, Ligustral, d-limonene, linalool, linalool oxide, linalyl acetate, linalyl formate, menthone, menthyl acetate, methyl acetophenone, methyl amyl ketone, methyl anthranilate, methyl benzoate, methyl benzyl acetate, methyl chavicol, methyl eugenol, methyl heptenone, methyl heptine carbonate, methyl heptyl ketone, methyl hexyl ketone, alpha-iso "gamma" methyl ionone, methyl nonyl acetaldehyde, methyl octyl acetaldehyde, methyl phenyl carbinyl acetate, methyl salicylate, myrcene, neral, nerol, neryl acetate, nonyl acetate, nonyl aldehyde, octalactone, octyl alcohol (octanol-2), octyl aldehyde, orange terpenes (d-limonene), para-cresol, para-cresyl methyl ether, para-cymene, para-methyl acetophenone, phenoxy ethanol, phenyl acetaldehyde, phenyl ethyl acetate, phenyl ethyl alcohol, phenyl ethyl dimethyl carbinol, alpha-pinene, beta-pinene, prenyl acetate, propyl butyrate, pulegone, rose oxide, safrole, alpha-terpinene, gamma-terpinene, 4-terpinenol, alpha-terpineol, terpinolene, terpinyl acetate, tetrahydro linalool, tetrahydro myrcenol, undecenal, veratrol, verdox, vertenex, viridine, and a mixture thereof.

10. The composition of claim 1, wherein the fabric conditioning component comprises at least one of methyl bis(tallowamidoethyl)-2-hydroxyethyl ammonium methyl sulfate, and methyl bis(hydrogenated tallowamidoethyl)-2-hydroxyethyl ammonium methyl sulfate, methyl bis(stearyloyloxyethyl)-2-hydroxyethyl ammonium methyl sulfate, dimethyl bis(stearyloyloxyethyl) ammonium methyl sulfate, methyl bis(hydrogenated tallowoyloxyethyl)-2-hydroxyethyl ammonium methyl sulfate, or a mixture thereof.

11. The composition of claim 1, wherein said carrier component comprises at least one of ethylene bisamides, primary alkylamides, alkanolamides, polyamides, alcohols containing at least 12 carbon atoms, alkoxylated alcohols containing at least 12 carbon atoms, carboxylic acids containing at least about 12 carbon atoms, a derivative thereof, or a mixture thereof.

12. The composition of claim 11, wherein said carrier component comprises at least one of ethylenebistearamide, ethylenebisoleamide, ethylenebisbehenamide, stearyl alcohol, or behenyl alcohol.

13. The composition of claim 1, further comprising at least one of: soil release agent, chelant, dye transfer inhibitor, dye fixative agent, chlorine scavenging agent, optical brightener, odor control agent, antimicrobial agent, fungicide, wrinkle control agent, anti-oxidant, preservative, insect repellent, moth repellent, processing aid, plasticizer, mold release agent, or a mixture thereof.

14. A method of softening a fabric comprising the step of contacting said fabric with a composition according to claim 1.

* * * * *

UNITED STATES PATENT AND TRADEMARK OFFICE

CERTIFICATE OF CORRECTION

PATENT NO. : 8,058,224 B2
APPLICATION NO. : 11/059709
DATED : November 15, 2011
INVENTOR(S) : Morgan, III et al.

It is certified that error appears in the above-identified patent and that said Letters Patent is hereby corrected as shown below:

Column 21

Line 5, delete “for” and insert --flor--.

Line 7, delete “gamma-nonalactonc” and insert --gamma-nonalactone--.

Signed and Sealed this
Twenty-fifth Day of September, 2012

David J. Kappos

David J. Kappos
*Director of the United States Patent and Trademark Office*